United States Patent [19]

Suzuki

[11] Patent Number: 4,702,043

[45] Date of Patent: Oct. 27, 1987

[54] APPARATUS FOR TURNING UP AND DOWN SEATS FOR A TELESCOPIC SEATING SYSTEM

[75] Inventor: Fumihiko Suzuki, Tokyo, Japan

[73] Assignee: Kabushiki Kaisha Kotobuki, Tokyo, Japan

[21] Appl. No.: 896,409

[22] Filed: Aug. 14, 1986

[30] Foreign Application Priority Data

Feb. 28, 1986 [JP] Japan ..... 61-43358

[51] Int. Cl.[4] ..... E04H 3/12

[52] U.S. Cl. ..... 52/9

[58] Field of Search ..... 52/8, 9, 10; 297/325, 297/331-336

[56] References Cited

U.S. PATENT DOCUMENTS

| | | | |
|---|---|---|---|
| 4,155,202 | 5/1979 | Hartman | 52/9 |
| 4,195,451 | 4/1980 | Jarvis | 52/8 |
| 4,446,659 | 5/1984 | Quigley | 52/9 |
| 4,569,162 | 2/1986 | Suzuki | 52/9 |

*Primary Examiner*—John E. Murtagh

*Attorney, Agent, or Firm*—Oldham, Oldham and Weber, Co.

[57] ABSTRACT

An apparatus for turning up and down a spectator's seats includes a foot member which is turnably supported within a base frame fixedly mounted on the movable platform. A pair of Y-shaped lock links are supported turnable about a support shaft which extends throught the fore end thereof. The upper portions of the lock links rotatably support a locking and unlocking roller therebetween and this roller serves as a weight. On the other hand, the lower portions of the lock links are formed with a hook respectively. A locking angle is fixedly secured to both the side walls of the base frame at the position located behind foot member in such a manner that the hooks are engaged to the locking angle to firmly hold the foot member in the upright standing posture when the roller is lowered by turning movement. Engagement of the hooks to the locking angle can be released by abutment of the roller against the front nose on the upper movable platform during backward movement of the first-mentioned movable platform. The foot member has a shaft about which it is adapted to turn and the shaft has spring means mounted thereon on both the sides of the foot member to normally turn up the foot member toward the upright standing posture. The base frame is provided with stopper bolts adapted to inhibit the seat from turning backwardly as well as adjustment bolts adapted to inhibit it from turning forwardly.

6 Claims, 6 Drawing Figures

APPARATUS FOR TURNING UP AND DOWN SEATS FOR A TELESCOPIC SEATING SYSTEM

BACKGROUND OF THE INVENTION

1. Field of the Invention

The present invention relates to an apparatus for turning up and down seats for a telescopic seating system and more particularly to an apparatus for automatically turning up and down spectator's seats for a telescopic seating system of the type including a plurality of movable platforms which are arranged in their wherein they are displaced forwardly in the jointed state one after another when the telescopic seating system is in use and they are displaced backwardly in the reverse manner when it is not in use.

2. Description of the Prior Art

In recent years a telescopic seating system including a plurality of movable platforms arranged in tier is increasingly employed for a building such as gymnasium or the like in order to utilize the floor space more effectively by fully accommodating all the movable platforms in a cavity formed on the one side wall structure of the building when the system is not in use. The movable platforms employable for the telescopic seating system are arranged in the form of a so-called doll tier stand in such a manner that the foremost movable platform is located at the lowermost position and the rearmost movable platform is located at the highest position when the system is in use while all the movable platforms assume their extended position. They are operatively connected to one another and they can assume the extended position in the doll tier stage-shaped configuration by starting forward movement with the lowermost movable platform. After all the movable platforms assume the extended position, the seats are raised up so as to allow spectators to seat on them. On the other hand, when utilization of the system is completed, they are successively accommodated in the cavity of the building without any projection outwardly of the wall surface by starting rearward movement in the reverse manner with the lowermost movable platform.

However, the conventional telescopic seating system as constructed in the above-mentioned manner has the following problems.

Namely, in the conventional telescopic seating system it is necessary that all the seats are manually turned up one by one by personnels employed by the building after all the movable platforms assume their extended position to utilize the system. Moreover, after completion of utilization of the system they should be manually turned down one by one by them before the movable platforms are accommodated in the cavity of the building. Accordingly, a large number of man-hours are required for manually turning up and down a number of seats at every time before utilization of the system and after completion of utilization of the same, resulting in the system being operated at an increased cost. Thus, the gymnasium or the like building in which the system is installed is used at a reduced economical efficiency.

To obviate the foregoing problems there was already made a proposal for the conventional telescopic seating system as disclosed in U.S. Pat. No. 4,155,202. This proposed telescopic seating system is so constructed that all components constituting a seat are automatically folded and unfolded without any necessity for manual handling to be performed by personnels employed by the building. However, it has been pointed out that the proposed telescopic seating system has still drawbacks that it is complicated in structure and therefore it can be installed at an expensive cost.

SUMMARY OF THE INVENTION

Thus, the present invention has been made with the foregoing background in mind.

It is an object of the invention to provide an improved apparatus for automatically turning up and down seats for a telescopic seating system of the early-mentioned type which is entirely free from the drawbacks inherent to the conventional ones.

It is other object of the invention to provide an improved apparatus for automatically turning up and down seats for a telescopic seating system of the early-mentioned type which assures that the system can be used at a reduced cost and thereby a gymnasium or the like building can be utilized at a remarkably increased economical efficiency.

It is another object of the invention to provide an improved apparatus for automatically turning up and down seats for a telescopic seating system of the early-mentioned type which is simple in structure and can be manufactured at an inexpensive cost.

To accomplish the above objects there is proposed according to the invention an apparatus for automatically turning up and down spectator's seats for a telescopic seating system of the type including a plurality of movable platforms which are arranged in tier, the movable platforms being displaced forwardly one after another in the jointed state when the telescopic seating system is in use and being displaced backwardly in the reverse manner when it is not use, wherein the improvement consists in that a foot member is turnably supported within a base frame which is fixedly mounted on the movable platform, the bottom of each of the spectator's seats being fixedly placed on the top of the foot member, a pair of Y-shaped lock links disposed on both the sides of the foot member in the parallel state are supported turnable about a support shaft which extends through the fore end of the lock links, the upper portions of the lock links rotatably carrying a locking and unlocking roller therebetween which serves as a weight and the lower portions of the same being formed with a hook respectively, a locking angle is fixedly secured to the base frame at the position located behind the foot member in such a manner the hooks are engaged to the locking angle to firmly hold the foot member in the upright standing posture when the locking and unlocking roller is lowered by turning movement, and engagement of the hooks to the locking angle is released by abutment of the locking and unlocking roller against the adjacent upper movable platform.

When all the movable platforms are displaced forwardly to assume the extended state in the doll tier stand-shaped configuration for the purpose of utilization of the system, a driving unit installed in the system is actuated to start forward movement with the lowermost movable platform. This cause the apparatuses of the invention accommodated in the horizontally laid posture below the adjacent upper movable platform are caused to move forwardly together with the first-mentioned movable platform. During forward movement of each of the apparatuses, the rear end of the apparatus abuts against the front nose of the adjacent upper movable platform which is held immovable. Thereafter, the foot member is gradually raised up with the aid of resilient force of spring means as the base frame moves forwardly together with the movable platform. When the foot member is turned up to the position close to the upright standing posture, the locking and unlocking roller rotatably carried between the upper portions of the lock links is quickly lowered by turning movement and thereby hooks of the lower portions are engaged to the locking angle whereby the apparatus with a seat fixedly mounted thereon is kept in the completely locked state while maintaining the upright standing posture.

When all the movable platforms are accommodated in the cavity of the building after completion of utilization of the system, the driving unit is actuated to start backward movement with the lowermost movable platform. During backward movement, the locking and unlocking roller carried on the lock links abuts against the front nose of the adjacent upper movable platform, causing engagement of the hooks to the locking angle to be released. Thereafter, the foot member is turned down forwardly against resilient force of spring means under the effect of abutment of the roller against the upper movable platform until it assumes the horizontally laid posture. Thus, the apparatus is automatically accommodated below the upper movable platform without any necessity for manual handling.

Other objects, features and advantages of the invention will become readily apparent from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

Figure 1:
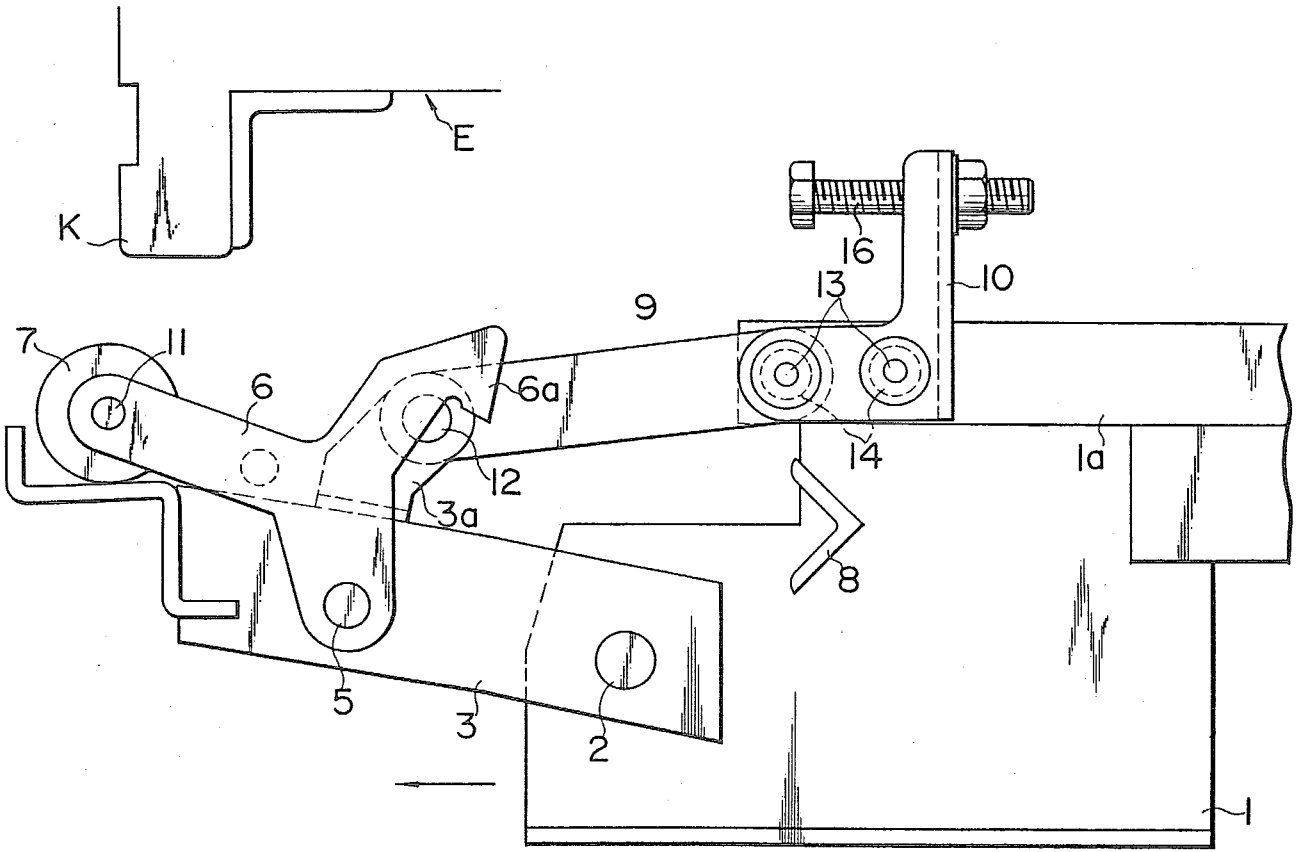
FIG. 1 is a sectional side view of an apparatus for automatically turning up and down spectator's seats in accordance with an embodiment of the invention, particularly illustrating the state that a foot member assumes the horizontally laid posture.

Now, the present invention will be described in a greater detail hereunder with reference to the accompanying drawings which illustrate a preferred embodiment thereof.

First, description will be made as to a telescopic seating system for which an apparatus for turning up and down seats according to the invention is employed. As is apparent from FIG. 6 which is a fragmental side view of the system, the whole telescopic seating system as identified by reference character A is fully extended in the forward direction while slidably moving on the floor H, when it is in use. Specifically, a plurality of movable platforms E having stanchions D attached thereto and a number of spectator's seats mounted thereon are successively drawn with the rollers C adapted to roll on the floor H in such a manner that one platform is operatively connected to another one which is located behind the former. Thus, when the system A assumes the extended position, it looks like a tier doll stand. On the other hand, when it is not in use, it is retracted to the initial position by way of the reverse steps to those as mentioned above. Specifically, the one moving platform thrusts the other one to move in the backward direction together with the latter until the whole system is completely accommodated in a cavity (not shown) which is located behind the shown system. Thus, when the system A assumes the storage position, no movable platform is projected forwardly of the wall surface of the cavity. As shown in the drawing, a plurality of apparatuses F for automatically turning up and down seats according to the invention (hereinafter referred to simply as apparatus) are arranged in the equally spaced relation in the longitudinal direction at the position located in the proximity of the stanchions D on each of the movable platforms E. Obviously, one apparatus F is allocated to one spectator's seat G.

Figure 3:
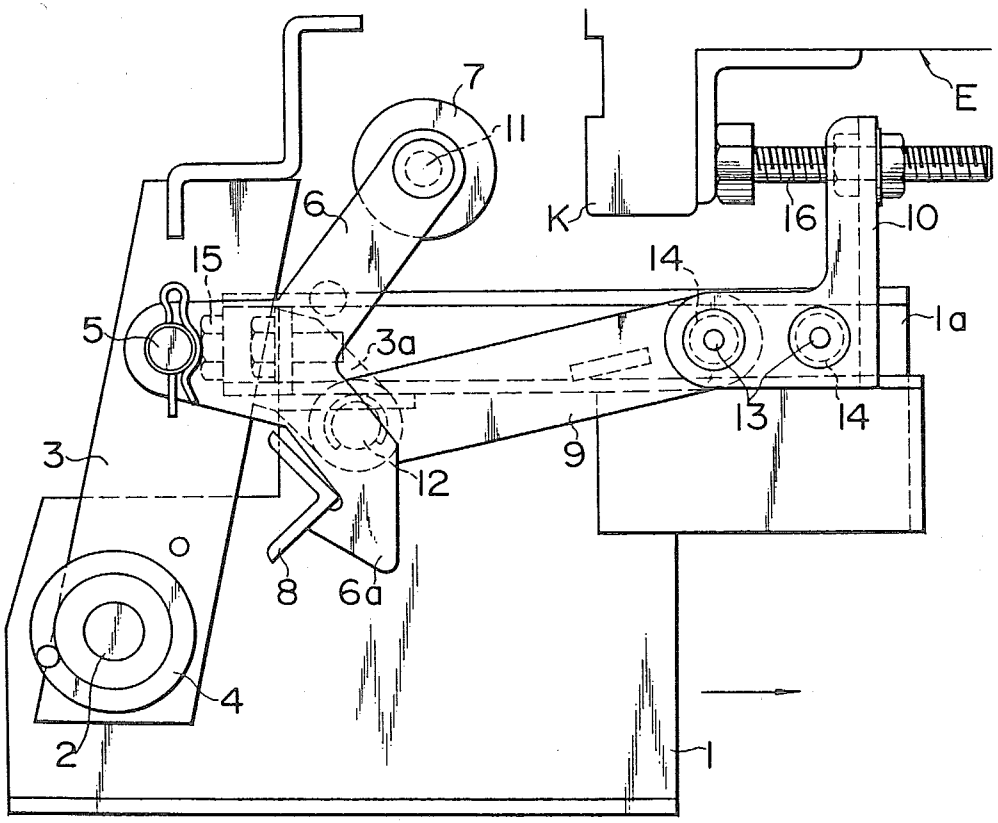
FIG. 3 is a sectional side view of the apparatus in FIG. 1, particularly illustrating that the foot member assumes the upright standing posture while it is kept in the locked state.
Figure 5:
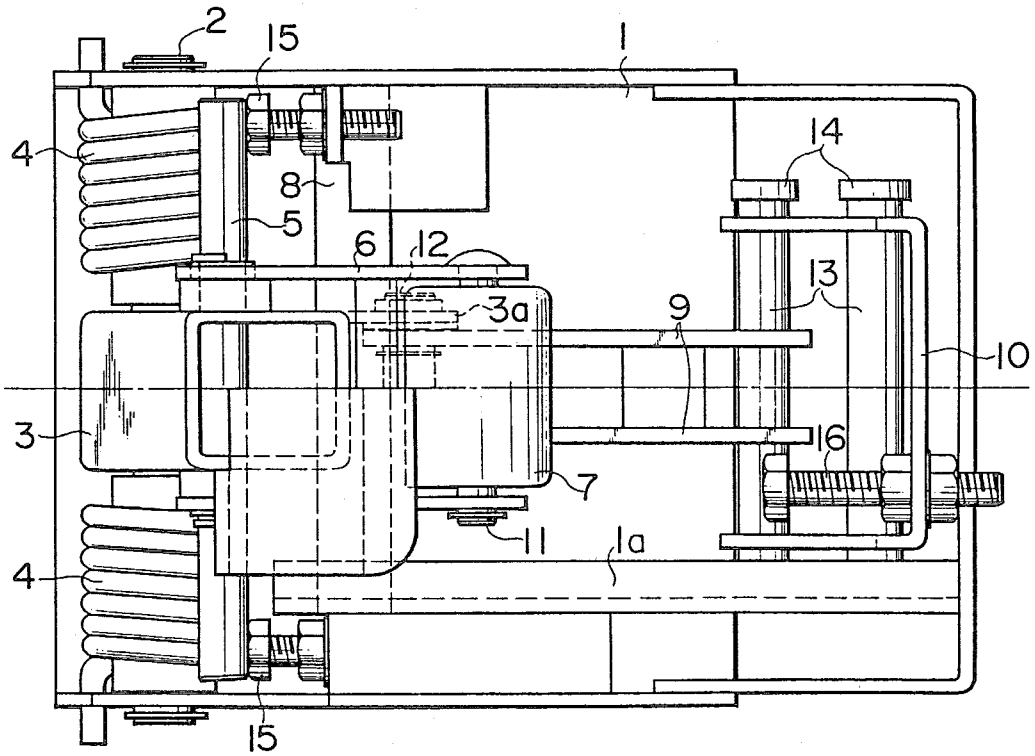
FIG. 5 is a plan view of the apparatus in FIG. 3.

Next, description will be made below as to how the apparatus F is constructed. As is best seen in FIGS. 3 and 5, the apparatus F includes a base frame 1, a foot member 3, a pair of lock links 6 and a locking angle 8 as essential components. The base frame 1 is made of metallic sheet material having a predetermined width and has a pair of slide rails 1*a* on both the sides of the upper end thereof. Each of the slide rails 1*a* has the U-shaped cross-sectional configuration and extends from the rear end to the middle part of the base frame 1 in the horizontal direction while maintaining the oppositely located state. (It should be noted that only one of the pair of slide rails 1*a* is not shown in FIG. 5 for the purpose of simplification of illustration.)

The foot member 3 is designed in the form of a sleeve having the substantially square cross-sectional configuration and has a pair of projections 3*a* on both the sides thereof each of which is formed with a pin hole at the foremost end. As is apparent from the drawings, the foot member 3 is supported within the space as defined by the base frame 1 in such a manner as to turn forwardly about a transversely extending support shaft 2 which is disposed at the position located at the lower fore end of the base frame 1. A pair of coil springs 4 adapted to raise up the foot member 3 under the effect of resilient force are mounted on the support shaft 2 on both the sides of the foot member 3. The one end of each of the coil springs 4 is fixedly engaged to the base frame 1 and the other end of the same is fixedly engaged to the foot member 3. The latter carries a shaft 5 at the middle part thereof which length is determined approximately equal to the distance between both the side walls of the base frame 1 and which extends in parallel with the support shaft 2. It should be added that the top end of the foot member 3 is fixedly secured to the bottom of the seat G in such a manner that the former turns up and down together with the latter.

Each of the lock links 6 is designed in the Y-shaped configuration using metallic sheet material and the upper portion has a length appreciably longer than the other two portions while a pin hole is formed at the foremost end thereof. The lower portion of the lock link 6 is formed with a hook 6a at the foremost end thereof which is adapted to come in engagement to the locking angle 8 to be described later. The longer portions of the Y-shaped lock links 6 extending in parallel with one another on both the sides of the foot member 3 carry a pin 11 at their foremost end onto which a locking and unlocking roller 7 serving as a weight is rotatably fitted. Since the fore portions of the Y-shaped lock links 6 are rotatably supported on the shaft 5, they are caused to turn up and down about the shaft 5.

In order to assure that the foot member 3 maintains the upright standing posture at a predetermined position when it is raised up under the effect of resilient force of the coil springs 4, the shaft 5 which transversely extends through the lock links 6 is adapted to abut against stopper bolts 15 which will be best seen in FIG. 5.

Figure 4:
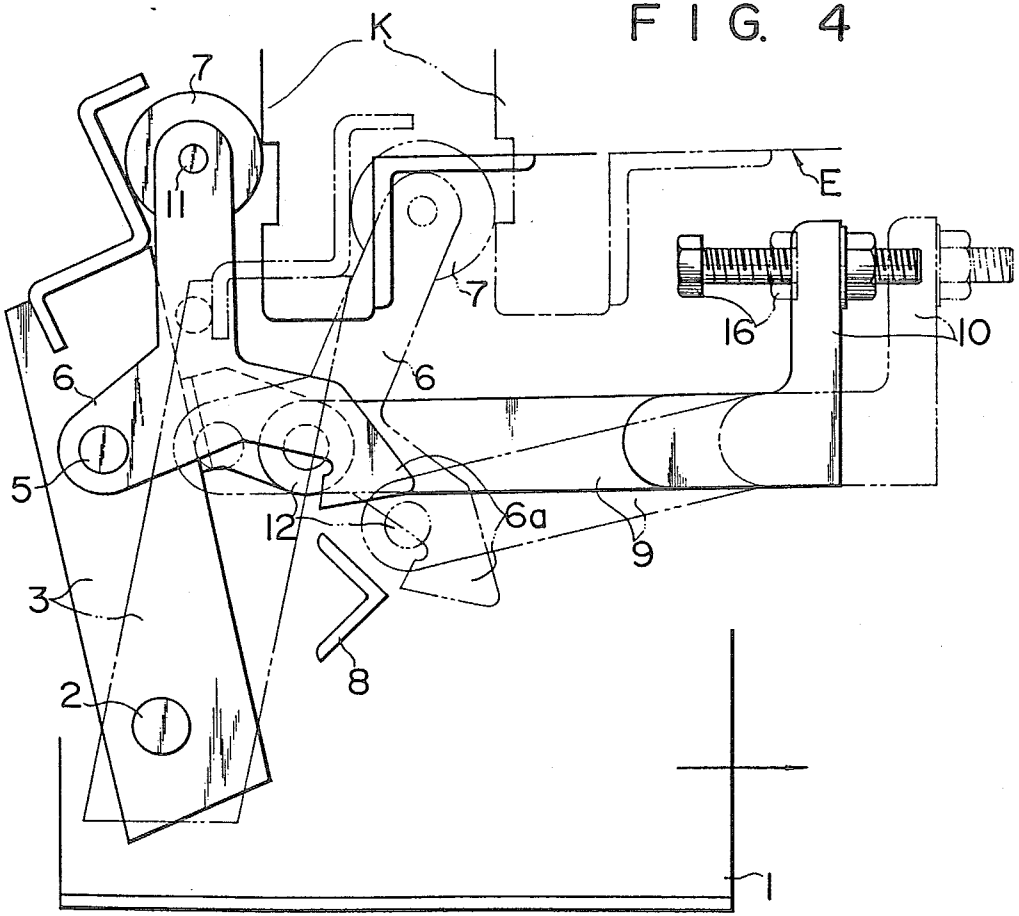
FIG. 4 is a sectional side view of the apparatus in FIG. 1, particularly illustrating by phantom lines that the foot member starts to turn down forwardly and by real lines that it is located at the intermediate position in the course of turning-down movement.

The locking angle 8 having the inverted L-shaped cross-sectional configuration is fixedly secured to both the inner walls of the base frame 1 by welding operation at the position located behind the middle part of the foot member 3 which has assumed the upright standing posture. As the foot member 3 is displaced by turning movement from the horizontally laid posture toward the upright standing posture, the lock links 6 also are displaced toward their upright standing posture together with the foot member 3. When the longer portions of the lock links 6 are displaced backwardly further beyond the vertical line which vertically extends through the axis of the shaft 5, the locking and unlocking roller 7 rotatably mounted on the pin 11 becomes effective as a weight. This causes the lock links 6 to rapidly turn rearwardly about the shaft 5 whereby the hooks 6a of the lock links 6 are brought in engagement to the locking angle 8. When there occurs a necessity for releasing the engaged state where the hooks 6a of the lock links 6 are engaged to the locking angle 8, the movable platform E is displaced backwardly until the locking and unlocking roller 7 abuts against a front nose K on the fore end of the upper movable platform E. As the movable platform E is displaced backwardly further, the lock links 6 are caused to turn about the shaft 5 in the anticlockwise direction whereby the hooks 6a are disengaged from the locking angle 8 (see FIG. 4).

As means for guiding turning-up movement as well as turning-down movement of the foot member 3 the apparatus employes a pair of links 9 and a slider 10 which are constructed in the following manner. Specifically, the one end of each of the links 9 is pivotally connected to the rear projection 3a of the foot member 3 with the use of a pin 12. The slider 10 is bridged between the pair of slide rails 1a which are disposed at the upper part of the base frame 1. It is made of metallic sheet material by bending operation so as to have the U-shaped configuration as seen from the above and the inverted L-shaped configuration as seen from the side. As will be best seen in FIG. 3, each of the side parts of the slider 10 is provided with two pins 13 on which a roller 14 is rotatably mounted and the other end of the link 9 is pivotally connected to the fore pin 13. Further, the upper part of the slider 10 is provided with adjustment screws 16 at both the ends thereof which are threadably extended through the slider 10 in parallel with one another. Since the slider 10 with the adjustment bolts 16 mounted thereon is operatively connected to the foot member 3 via the links 9, the adjustment bolts 16 on the slider 10 are caused to abut against the front nose K of the upper movable platform E which is located behind the first-mentioned movable platform E on which the apparatus F is mounted. As a result, the slider 10 serves as guide means for raising up the foot member 3 which has assumed the horizontally laid posture. The apparatus F of the invention has been constructed in the form of an integral unit in the above-described manner.

Figure 6:
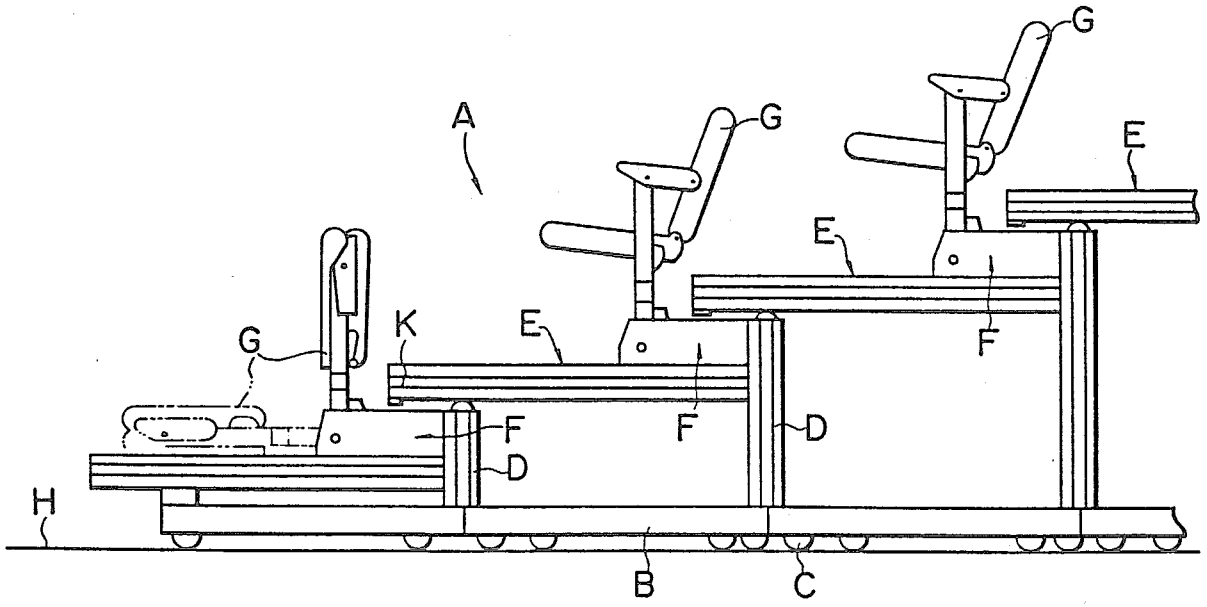
FIG. 6 is a fragmental side view of a telescopic seating system for which a number of apparatuses according to the invention are employed, wherein each of the apparatuses assumes the upright standing posture.

As shown in FIGS. 1, 5 and 6, the apparatus F is firmly mounted on the movable platform E so as to move together with the latter by way of the steps of locating the apparatus F in vertical alignment with the spectator's seat G in the equally spaced relation in the longitudinal direction on the movable platform E at the position adjacent to the stanchion D and fastening it to the movable platform E by means of a plurality of bolts which are inserted through holes (not shown) on the bottom of the base frame 1. It should be added that the bottom of the seat G is placed on the top of the foot member 3 and it is then fixed to the latter by means of a plurality of bolts so as to move and turn together with it.

As the movable platform E is retracted, the apparatus F moves backwardly together with it to gradually turn down from the upright standing posture until it is completely accommodated in the space as defined below the upper movable platform E. When all the movable platforms E are retracted without any projection outwardly of the vertical wall surface of the building, all the seats G inclusive the apparatuses E are accommodated in the horizontally laid posture in the space as defined between the adjacent upper and lower movable platforms E.

Next, operation of the apparatus of the invention will be described below.

When all the movable platforms E are arranged in tier for the purpose of utilizing the telescopic seating system A inclusive a number of apparatuses F, a driving unit (not shown) disposed in the telescopic seating system A is first actuated to successively displace the movable platforms E in the forward direction one after another. The apparatuses F which have been accommodated in the inoperative state where the foot members 3 are turned down together with the lock links 6 in the horizontally laid posture are then caused to move forwardly at the same time (see FIG. 1).

Figure 2:
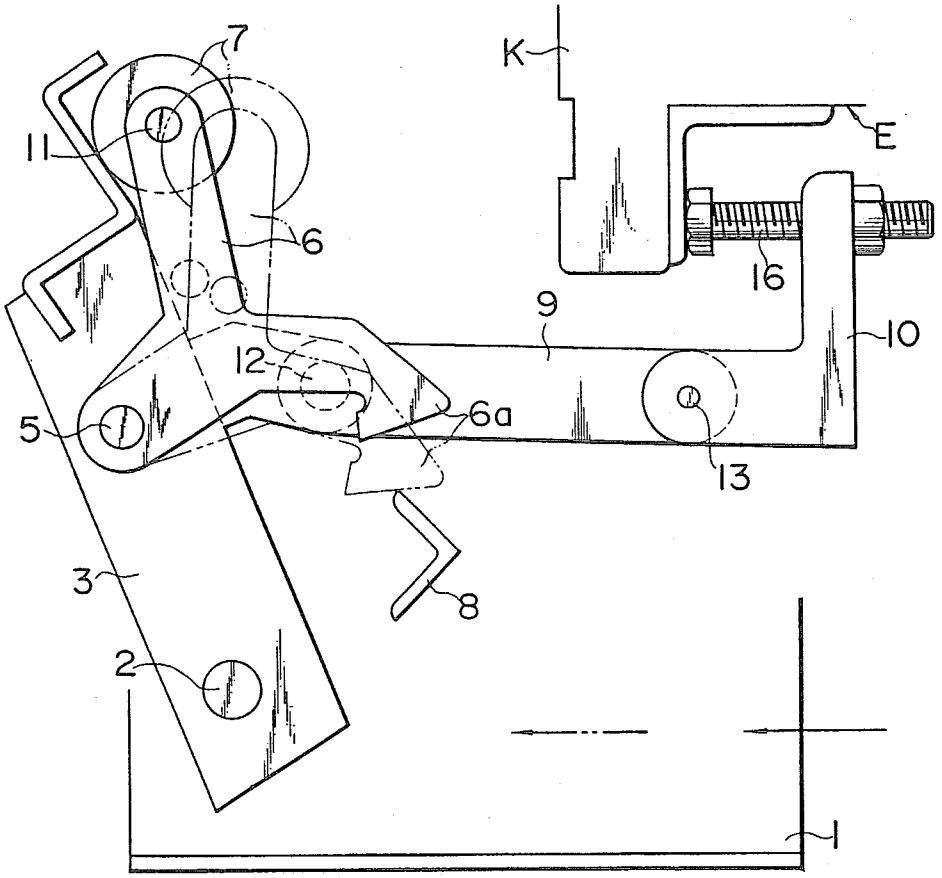
FIG. 2 is a sectional side view of the apparatus in FIG. 1, particularly illustrating how the foot member is caused to turn up toward the upright standing posture as a movable platform is displaced forwardly.

At this moment the slider 10 is kept immovable at the fore end of the slide rails 1a relative to the movable platform E while the foot member 3 is maintained in the horizontally laid posture. As the movable platform E moves forwardly further, the slider 10 also moves forwardly together with the movable platform E until the adjustment bolts 16 on the slider 10 abut against the front nose K on the fore end of the upper movable platform E. On abutment of the adjustment bolts 16 against the front nose K the slider 10 is inhibited from moving forwardly but the rollers 14 on the slider 10 slide along the slide rails 1a (see FIG. 2). Thus, forward movement of the upper part of the foot member 3 is inhibited due to operative connection established by way of the projections 3a, the links 9 and the slider 10 and thereby it is kept immovable. However, since the lower part of the foot member 3 through which the support shaft 2 extends continues to move forwardly together with the base frame 1, the foot member 3 is gradually caused to turn up toward the upright standing posture in the automatic manner with the aid of resilient force of the coil springs 4 as the base frame 1 moves forwardly.

Thereafter, when the base frame 1 is brought in the immovable state as a result of stoppage of the movable platform E, the lock links 6 which is operatively connected via the shaft 5 to the foot member 3 which has assumed the upright standing posture is also transferred to the upright standing posture. Since the lock links 6 are supported turnable about the shaft 5 which is located at the middle part thereof, they start to move under the effect of gravity force of their dead weight toward the operative state where they are engaged to the locking angle 8, after they assume the upright standing posture (that is, the operative state where their longer portion extends in the vertical direction). Specifically, the locking and unlocking roller 7 which has been held in contact with the upper part of the foot member 3 is caused to lower rearwardly of the foot member 3 under the effect of gravity force of its dead weight and thereby it becomes effective as an additional weight for promoting lowering movement of the lock links 6. Thus, when the foot member 3 is stopped while assuming the upright standing posture, the lock links 6 are brought in engagement to the locking angle 8 whereby the seat G which is assembled integral with the foot member 3 can maintain the upright standing posture in the locked state (see FIGS. 3 and 6). As will be best seen in FIG. 3, the hooks 6*a* on the lock links 6 are firmly engaged to the locking angle 8, resulting in no fear of causing the seat to turn forwardly.

As will be best seen in FIG. 5, since the shaft 5 which transversely extends through the upper part of the foot member 3 abuts against both the stopper bolts 15, there is no fear of causing the seat to turn backwardly from the upright standing posture and thereby the reliably locked state can be maintained easily. Accordingly, stable seating state is obtainable by steadily maintaining the reliably locked state irrespective of how a spectator on the seat G shakes or vibrates. It should be noted that all the seats G on each of the tiers are raised up concurrently in union.

Next, when all the movable platforms E are accommodated in the cavity of the building in vertical alignment one above another without any projection outwardly of the vertical side wall of the building after completion of utilization of the telescopic seating system A, the driving unit (now shown) installed in the latter is actuated again to successively displace the movable platforms E backwardly starting with the foremost one. Specifically, as the movable platform E is displaced backwardly, the locking and unlocking roller 7 on the lock links 6 carried on the foot member 3 in the rearwardly turned state is caused to move backwardly together with the movable platform E until it abuts against the front nose K on the upper movable platform E in the course of backward movement of the first-mentioned movable platform (see the operative state as represented by phantom lines in FIG. 4). On abutment of the locking and unlocking roller 7 against the front nose K in that way the hooks 6*a* are disengaged from the locking angle 8 and the seat is then turned down forwardly by means of the lock links 6 as the roller 7 is thrusted further with the front nose K.

After the locking and unlocking roller 7 is raised up and then comes in contact with the rear surface of the foot member 3, the latter which has been kept in the upright standing posture is thrusted with the lock links 6 from the behind whereby it is gradually turned down forwardly against resilient force of the coil springs 4. During turning movement of the foot member 3 in that way, the center of weight of the seat G is desplaced forwardly of that of the foot member 3, causing the locking and unlocking roller 7 to be parted away from the front nose K on the upper movable platform E. This leads to a result that summation of weight of the seat G and weight of the foot member 3 exceeds resilient force of the coil springs 4 without any influence of thrust force of the front nose K. Thus, the seat G which is assembled integral with the foot member 3 can be turned down smoothly, easily and automatically without any necessity for manual operation during retracting movement of the movable platform E. The above-mentioned steps of operations of the apparatus F are repeatedly carried out until all the movable platforms E are completely accommodated in the cavity of building (see FIG. 1).

As will be readily apparent from the above description, the apparatus of the invention is so constructed that a foot member is turnably supported within a base frame which is fixedly mounted on the movable platform, the bottom of each of the spectator's seats being fixedly placed on the top of the foot member which is normally urged to turn up toward the upright standing posture under the effect of resilient force of spring means, a pair of Y-shaped lock links disposed on both the sides of the foot member in parallel state are supported turnable about a support shaft which extends through the fore end of the lock links, the upper portions of the lock links rotatably carrying a locking and unlocking roller therebetween which serves as a weight and the lower portions of the same being formed with a hook respectively, a locking angle is fixedly secured to the base frame at the position located behind the foot member in such a manner that the locking and unlocking roller is engaged to the locking angle to firmly hold the foot member in the upright standing posture when it is lowered by turning movement, and engagement of the hooks to the locking is released by abutment of the locking and unlocking roller against the upper movable platform during backward movement of the first-mentioned movable platform. By virtue of the arrangement made for the apparatus in that way it becomes possible to automatically turn up and down each of the seats which are assembled integral with the foot members on each of the tiers in operative association with forward and backward movement of the movable platform. As a result, the apparatus of the invention has advantageous features that cost required for utilization of the telescopic seating system for which the apparatuses are employed can be reduced remarkably and the telescopic seating system can be used for many kinds of buildings such as gymnasium or the like at a highly increased economical efficiency.

While the present invention has been described above only with respect to a single preferred embodiment thereof, it should of course be understood that it should not be limited only to this but various changes or modifications may be made in any acceptable manner without departure from the spirit and scope of the invention as defined by the appended claims.

What is claimed is:

1. In an apparatus for automatically turning up and down spectator's seats for a telescopic seating system of the type including a plurality of movable platforms which are arranged in tier, said movable platforms being displaced forwardly one after another in the jointed state when said telescopic seating system is in use and being displaced backwardly in the reverse manner when it is not in use, the improvement consisting in that;

a foot member is turnably supported within a base frame which is fixedly mounted on the movable platform, the bottom of each of said spectator's seats being fixedly placed on the top of said foot member, a pair of Y-shaped lock links disposed on both the sides of the foot member in the parallel state are supported turnable about a support shaft which extends through the fore end of said lock links, the upper portions of the lock links rotatably carrying a locking and unlocking roller therebetween which serves as a weight and the lower portions of the same being formed with a hook respectively, a locking angle is fixedly secured to the base frame at the position located behind the foot member in such a manner that said hooks are engaged to said locking angle to firmly hold the foot member in the upright standing posture when the locking and unlocking roller is lowered by turning movement, and engagement of the hooks to the locking angle is released by abutment of the locking and unlocking roller against the front nose of the adjacent upper movable platform during backward movement of the first-mentioned movable platform.

2. An apparatus as defined in claim 1, wherein the foot member includes a shaft about which it is adapted to turn, said shaft having a pair of spring means mounted thereon on both the sides of the foot member, said spring means serving to normally turn up the foot member toward the upright standing posture.

3. An apparatus as defined in claim 1, wherein the base frame is provided with a pair of stopper bolts at the position located in the proximity of the side walls thereof in such a manner that the support shaft about which the lock links are adapted to turn abuts against said stopper bolts when the foot member is turned up to the upright standing state whereby the seat is inhibited from turning backwardly.

4. An apparatus as defined in claim 2, wherein the base frame is provided with a slider at the rear end part thereof which is operatively connected to the foot member via projections and links, said slider carrying adjustment bolts thereon which are adapted to abut against the front nose of the adjacent upper movable platform when the foot member is turned up the upright standing state whereby the seat is inhibited from turning forwardly.

5. An apparatus as defined in claim 4, wherein the base frame is formed with slide rails at the upper end parts of both the side walls so as to allow the slider to move back and forth along said slide rails.

6. An apparatus as defined in claim 1, wherein the lock links are so designed that when their longer portions are displaced backwardly beyond the vertical line which vertically extends through the axis of the support shaft, the locking and unlocking roller becomes effective as a weight, causing the lock links to rapidly turn rearwardly about the support shaft, whereby the hooks are brought in engagement to the locking angle.

* * * * *